United States Patent [19]

Sheratte

[11] 3,957,668

[45] May 18, 1976

[54] NOVEL EPOXY COMPOUNDS AND FUNCTIONAL FLUID COMPOSITIONS CONTAINING SUCH COMPOUNDS

[75] Inventor: Martin B. Sheratte, Reseda, Calif.

[73] Assignee: McDonnell Douglas Corporation, Long Beach, Calif.

[22] Filed: Sept. 24, 1973

[21] Appl. No.: 400,130

[52] U.S. Cl. ..... 252/78; 252/49.8

[51] Int. Cl.[2] ..... C10M 3/08

[58] Field of Search ..... 252/78, 49.8; 260/348 C

[56] References Cited

UNITED STATES PATENTS

| | | | |
|---|---|---|---|
| 2,853,498 | 9/1958 | Phillips et al. | 260/348 C |
| 3,637,507 | 1/1972 | Gentit | 252/78 |
| 3,723,320 | 3/1973 | Herber et al. | 252/49.8 |

*Primary Examiner*—Benjamin R. Padgett
*Assistant Examiner*—Deborah L. Kyle
*Attorney, Agent, or Firm*—Max Geldin

[57] ABSTRACT

Novel epoxides in the form of esters or polyesters of 4,5-epoxy-1,2-cyclohexane dicarboxylic acid, and functional fluid compositions containing said epoxides, such functional fluids consisting essentially of (1) a phosphate ester, e.g., dibutyl phenyl phosphate, or an amide of an acid of phosphorus, (2) a viscosity index improver, e.g., a polyglycol or polyglycol ether, or polyacrylate or polymethacrylate viscosity index improver, and (3) a small amount of the above novel epoxide, e.g., poly(ethylene-$\Delta^4$-epoxy tetrahydrophthalate), such epoxide preventing acid build-up in the fluid, and preventing undesirable deposits particularly when such fluid is employed as an aircraft hydraulic fluid.

33 Claims, No Drawings

NOVEL EPOXY COMPOUNDS AND FUNCTIONAL FLUID COMPOSITIONS CONTAINING SUCH COMPOUNDS

BACKGROUND OF THE INVENTION

Many different types of materials are employed as functional fluids, and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly important application of such functional fluids has been their utilization as hydraulic fluids and lubricants in aircraft, requiring successful operation of such fluids over a wide temperature range, and fire resistant fluids.

Functional and hydraulic fluids employed in many industrial applications and particularly hydraulic fluids for aircraft must meet a number of important requirements. Thus, such hydraulic fluids particularly for aircraft use, should be operable over a wide temperature range, should have good stability at relatively high temperatures and preferably have lubricating characteristics. In addition to having the usual combination of properties making it a good lubricant or hydraulic fluid, such fluid should also have relatively low viscosity at extremely low temperatures and an adequately high viscosity at relatively high temperatures, and must have adequate stability at the high operating temperatures of use. Further, it is of importance that such fluids be compatible with and not adversely affect materials including metals and non-metals such as seals of the system in which the fluid is employed. It is also important in aircraft hydraulic fluids and lubricants that such fluids have as high a fire resistance as possible to prevent ignition if such fluids are accidentally or as result of damage to the hydraulic system, sprayed onto or into contact with surfaces of materials of high temperature. Another important property for application of a hydraulic fluid in aircraft is the provision of a low density fluid to increase pay load.

Hydraulic fluids in commercial jet aircraft are exposed to temperatures ranging from below −40°F to over 200°F. Within these temperature extremes, it is necessary for the fluid to maintain a reasonably low viscosity when cold, and yet not become too thin when hot.

In presently available commercial functional or hydraulic fluids, phosphate esters are among the most commonly employed base stocks, of which tributyl phosphate and dibutyl phenyl phosphate are widely used components. Both of the latter phosphates are too thin at high temperatures, and their use alone would result in rapid wear of moving parts. Other phosphate esters, such as tricresyl phosphate, for example, which provides the requisite high temperature viscosity become too thick to be useful at low temperatures. Even mixtures of various phosphate esters such as those noted above do not provide the required viscosity characteristics at both low and high temperatures. Accordingly, it has been the practice to achieve the required wide viscosity range required for aircraft hydraulic fluids by adding to a thin base stock, such as phosphate ester or mixtures thereof, a small proportion, e.g., up to 10 percent, of a polymeric material such as polyalkyl acrylates or methacrylates, whose solubility characteristics in the base stock are chosen so that the polymeric material thickens the fluid more at high temperatures than at low temperatures, and thus functions as a viscosity index (VI) improver.

However, during use, fluids of the above type containing polymers such as the polyalkyl acrylates or methacrylates, tend to decompose due to the shearing forces of the mechanical components encountered in an aircraft hydraulic system, on the fluid, and producing acids. This results in a high degree of acid build-up during use, which is detrimental in causing corrosion of metal surfaces with which the fluid is in contact and also causes further decomposition of the fluid.

In U.S. Pat. No. 3,637,507, improved acid stability of such functional or hydraulic fluids is achieved by the addition of monoepoxides and particularly certain diepoxides to hydraulic fluids containing a phosphate ester and particularly polymethacrylate and polyacrylate viscosity index improver. However, in currently manufactured fluids of this type, the functionality of the epoxide is severely limited by the reaction which epoxides can have with acrylate and methacrylate viscosity index improver. Thus, although diepoxides such as the 3,4-epoxycyclohexylmethyl 3,4-epoxycyclohexane carboxylate disclosed in the above patent are preferred over the monoepoxide in the above fluids, the concentration of the latter diepoxide must be kept low since the reaction of polyfunctional epoxides with acrylate and methacrylate type viscosity index improvers leads to the formation of harmful insoluble deposits. Thus, it is particularly noteworthy that in all of the examples of the above patent, and employing polyalkyl methacrylate viscosity index improver, the concentration of the epoxide component, including the above-noted preferred diepoxide of the patent, is employed in a concentration ranging only from about 0.5 to about 1 percent. The necessity for using such low concentrations of such diepoxides in order to avoid formation of undesirable deposits in the fluid, due to reaction with acrylate and methacrylate viscosity index improvers, limits the effectiveness of such epoxides in preventing acid build-up.

According to my copending application, Ser. No. 400,122, filed Sept. 24, 1973, entitled "Functional Fluid Compositions", it was found that polyepoxides of high epoxide functionality can be effectively employed as acid absorbers in functional or hydraulic fluids, employing particularly a phosphorus ester, or mixtures thereof, when utilizing as viscosity index improver, a glycol material such as a polyglycol or a polyglycol ether, instead of polyacrylates, to prevent precipitation of harmful deposits in the fluid.

The advantage of employing polyepoxides lies in their generally greater efficiency in acid absorption over the monoepoxides. This is due to the fact that monoepoxides of relatively high molecular weight must be used in functional and hydraulic fluids to avoid skin sensitization and volatility problems. On the other hand, polyepoxides of substantially the same molecular weight contain more epoxy groups, and hence can absorb more acid per unit weight. The ability to employ polyepoxides to obtain this advantage is achieved according to the invention of my above copending application by the use of a polyglycol or polyglycol ether as viscosity index improver, since the latter viscosity index improvers do not react with the polyepoxides, whereas such polyepoxides do react with acrylate and methacrylate viscosity index improvers to form harmful deposits as noted above.

However, many presently available polyepoxides such as, for example, the epoxy novolacs, have very high viscosities and adversely affect the viscosity characteristics of the fluid, particularly when used as an aircraft hydraulic fluid. Hence it has been found particularly desirable to develop epoxides and polyepoxides of reduced viscosity, which when added to functional fluids, expecially functional or hydraulic fluids containing as base stock a phosphorus compound, particularly a phosphate ester, and a viscosity index improver, e.g., a polyacrylate, polymethacrylate or a polyglycol ether, efficiently absorb acids and do not adversely effect the desirable viscosity characteristics of the fluid.

Accordingly, the present invention relates to novel epoxides, including monoepoxides and polyepoxides, and to functional fluid compositions containing such epoxides, said fluid compositions having good fire resistance and desirable viscosity characteristics at both high and low temperatures, and is particularly directed to functional fluid compositions having the above-noted properties and consisting essentially of a phosphorus compound, especially a phosphate ester, a viscosity index improver, such as a polyglycol or a polyglycol ether, polyacrylate or polymethacrylate, and a novel epoxide of a type which permits use of a high concentration of such epoxide in conjunction with said viscosity index improver, to effectively prevent formation of harmful insoluble deposits in the fluid while effectively functioning as an acid absorber to prevent acid build-up, and which does not adversely affect the viscosity characteristics of the fluid.

DESCRIPTION OF THE INVENTION

According to the present invention, there is provided a class of novel epoxy compounds, including mono- and polyepoxides, which are esters or polyesters of 4,5-epoxy-1,2-cyclohexane dicarboxylic acid, otherwise termed herein esters or polyesters of $\Delta^4$-epoxy tetrahydrophthalic acid or $\Delta^4$-epoxy tetrahydrophthalate esters or polyesters, as defined in greater detail below. These novel epoxides including polyepoxides having high epoxide functionality, can be effectively employed in minor amount as acid absorbers in functional or hydraulic fluids, employing particularly a phosphorus ester, or mixtures thereof, and a viscosity index improver, to prevent precipitation of harmful deposits in the fluid, while at the same time having substantially less adverse affect upon the viscosity characteristics of the fluid containing the viscosity index improver, as compared to certain prior art epoxides, such as epoxidized oils, for example, epoxidized soya bean and tall oils, and epoxy novolacs.

The novel above-noted epoxides or esters are effective when employed in combination with a polyglycol or a polyglycol ether, as viscosity index improver, and permitting use of relatively high concentrations of the epoxide, e.g., polyepoxide, in such fluid for effective control of any acid formed in the fluid, and consequently controlling or preventing precipitation of any harmful deposits as result of decomposition of the fluid by the presence of such acid. It has also been found surprisingly, however that when certain of the novel epoxy compounds hereof, particularly the monoepoxy derivatives, are employed in a functional fluid containing a phosphorus compound such as a phosphate ester, and polyacrylate or poly-methacrylate type viscosity index improvers, effective acid control and prevention of harmful insoluble deposits is also achieved, although other types of epoxides, particularly polyepoxides, as noted above, tend to form harmful deposits in the presence of such acrylate or methacrylate type viscosity index improvers, due to reaction particularly of the latter polyepoxides with such viscosity index improvers. Thus, relatively high concentrations of the novel epoxides hereof having relatively low viscosity can be employed in the latter type functional fluids containing acrylate type viscosity index improvers as well as the foregoing glycol type viscosity index improvers, to prevent acid build-up and formation of deposits in the fluid.

In addition to their use as additives in functional or hydraulic fluids as noted above, the novel epoxy compounds or polyepoxides of the present invention have utility in adhesives, paints, potting compounds, and the like, as a replacement for conventional epoxides employed therein.

The novel epoxy compounds or polyesters of 4.5-epoxy-1,2-cyclohexane dicarboxylic acid according to the invention have the following general formula:

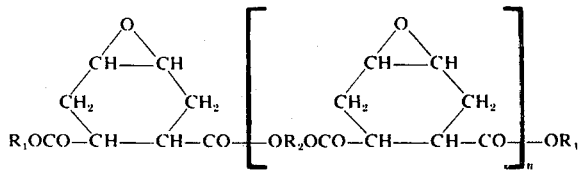

wherein $R_1$ is a monovalent radical selected from the group consisting of alkyl of from 1 to 10 carbon atoms, including methyl, ethyl, propyl, butyl, isobutyl, amyl, isoamyl, pentyl, hexyl, octyl, isooctyl, 2-ethyl butyl, and the like, aryl of from 6 to 9 carbon atoms including phenyl, tolyl, xylyl, and the like, alkoxy alkyl wherein the total number of carbon atoms ranges from 2 to about 10, such as methoxy methyl, ethoxy ethyl, ethoxy propyl, propoxy butyl, butoxy isopropyl, and the like, and substituted aryl such as halogenated aryl of from 6 to 9 carbon atoms, and one or more, e.g., 1 to 3, halogen atoms, e.g., chlorophenyl, bromophenyl, and the like, and $R_2$ is a divalent radical selected from the group consisting of alkylene of from 2 to 4 carbon atoms, including ethylene, propylene and butylene, polyalkylene oxides, the alkylene group thereof containing from 2 to 4 carbon atoms, such as polyethylene oxide, polypropylene oxide and the like, arylene oxides containing from 6 to 15 carbon atoms, including hydroquinone, resorcinol and bisphenol A, and wherein a portion of the $R_2$ radical can be replaced by $R_3$, which is a polyvalent radical of the hydrocarbon portion of a polyhydric alcohol, e.g., a trihydric or tetrahydric alcohol, such as glycerol, pentaerythritol, trimethylolpropane, and the like, and wherein n can range from 0 to about 50, and when such epoxides are employed particularly in hydraulic fluids, *n* can range from 0 to about 10, and when employed as polyepoxides, from about 1 to about 10, particularly about 1.5 to about 10.

Molecular weights of the above epoxides can range from about 250 to about 10,000, and for preferred polymers particularly useful for incorporation in functional or hydraulic fluids, the molecular weight ranges from about 500 to about 2,000, corresponding to *n* ranging from about 1 to about 8. The epoxy equivalency can range generally from about 200 to about 1,000, preferably about 250 to about 300, the epoxy equivalent being defined as the molecular weight per epoxy group.

The monoepoxides of the present invention can be prepared by reacting maleic anhydride with an alcohol, e.g. butanol, to form the ester, and the ester epoxidized, e.g., with monoperphthalic acid.

The novel polyepoxides or polyesters of the present invention can be prepared, according to one mode of procedure, by condensation of maleic anhydride with a polyol such as ethylene glycol, a chain terminating alcohol such as n-butanol being included in the initial polymerization step to control the size or molecular weight of the desired polyester molecules, treating the so-formed polyester with butadiene to form a polyester of cyclohexene dicarboxylic acid, and finally epoxidizing such cyclohexene ring.

According to an alternative mode of procedure, the polyepoxides of the present invention can be prepared by reacting tetrahydrophthalic anhydride with a polyol such as ethylene glycol to form a polyester of cyclohexene dicarboxylic acid, the presence of a chain terminating alcohol such as n-butanol being included in the reaction for controlling chain length, followed by epoxidizing the cyclohexene ring of the polymer.

The above procedures for producing the polyepoxides can be further modified by employment of a polyalkylene glycol in place of ethylene glycol. Such modification can produce epoxy resins which although not advantageous for use in hydraulic fluids, will cure to more flexible solids, the resulting cross-linked solids having advantageous properties such as high impact resistance, and high strength at low temperatures, e.g., for use as potting compounds.

A still further modification of the above procedures for producing the polyepoxides is to introduce glycerol, pentaerythritol or other polyols, in place of or in combination with a diol such as ethylene glycol. By appropriate choice of polyglycols and polyols, room temperature curing thermally stable rubbers with properties comparable to those of the polyurethanes may be prepared.

The following are examples of preparation of the novel epoxides or polyesters of the invention.

EXAMPLE 1

A. Poly-(ethylene maleate), butyl ester terminated

Maleic anhydride (98g, 1.0 Mole) was dissolved in 325 ml hot toluene containing 0.5G p-toluene sulphonic acid. Ethylene glycol (55.8g, 0.9 Mole) was added and the mixture was refluxed while the water evolved was collected in a Dean-Stark apparatus.

After 48 hours, evolution of water stopped when 15.5 cc water had been collected (theoretical 16.2g). At the end of the 48 hours refluxing period, 50 cc n-butanol was added, and the mixture heated under reflux for a further 24 hours, during which time a further 3.2 cc water was collected (theoretical 2.5 cc).

The product was washed with 10 percent sodium bicarbonate solution, and dried over sodium sulphate. Removal of excess solvent left 148g colorless polymer (theoretical 149.6).

B. Butyl ester terminated poly-(ethylenetetrahydrophthalate)

The above product, butyl ester terminated poly-(ethylenemaleate) (15g) was dissolved in toluene, and heated under reflux for 6 hours while butadiene was bubbled through the solution. At the end of this time, absorption of the butadiene had stopped. The solution was cooled and the toluene was vacuum stripped, leaving 20.2g polymer (theoretical 20.3g).

C. Poly-(ethylene-$\Delta^4$-epoxy tetrahydrophthalate)

The above polyester (20g) was dissolved in 100cc chloroform and epoxidized by treatment with 20g monoperphthalic acid (10 percent excess) at room temperature for 24 hours. The epoxidized solution was filtered from precipitated phthalic acid and extracted with sodium carbonate solution to remove excess monoperphthalic acid. After drying the chloroform was removed to yield 21g of a pale yellow oil (theoretical yield 21.7g). The oil had an epoxide equivalent of 260, indicating almost complete epoxidation.

EXAMPLE 2

A. Poly-ethylene-tetrahydrophthalate) butyl ester terminated

Cis-tetrahydrophthalic anhydride (30.4g, 0.2 Mole) was dissolved in 125 ml toluene. Ethylene glycol (11.16 g, 0.18 Mole) was added, together with 0.2g p-toluene sulphonic acid. The mixture was stirred under reflux for 18 hours, and the water evolved was separated in a Dean-start apparatus. (About 3cc water was collected). At the end of this time, an excess (approximately 20cc) of n-butanol was added, and refluxing was continued for a further 24 hours.

The product was washed with dilute sodium carbonate solution, then water and finally dried over sodium sulphate. Removal of the toluene and excess butanol left a colorless oil.

B. Poly-(ethylene-$\Delta^4$-epoxy tetrahydrophthalate)

This was prepared from the above poly-ethylene-tetrahydrophthalate in the same manner as described in Example 1C above.

The polymer or compound prepared according to the above Examples 1 and 2 and designated compound A, has a formula corresponding to the general formula noted above, wherein $R_1$ is $CH_3-(CH_2)_2CH_2-$ and $R_2$ is $-CH_2-CH_2-$, and had a molecular weight of approximately 2,000, indicating a degree of polymerization ($n$ in the general formula) of about 8 units. Longer or shorter chains can be prepared by adjusting the relative proportions of the reactants.

EXAMPLE 3

Preparation of Branched Poly-epoxide

Cis-tetrahydrophthalic anhydride (30.4g, 0.2 Mole) was dissolved in 125 ml toluene. Ethylene glycol (9.92g, 0.16 Mole) and glycerol (1.20g, 0.013 Mole) were added, together with 0.2g p-toluene sulphonic acid. The mixture was stirred under reflux for 18 hours during which time about 3cc of water was collected. At the end of this time, about 20cc n-butanol was added and the refluxing continued for a further 24 hours.

40g stiff oily polymer was recovered, which was epoxidized with monoperphthalic acid dissolved in chloroform as noted above in Example 1C, to form the polyester designated compound B.

EXAMPLE 4

Maleic anhydride (49g, 0.5 Mole) was dissolved in 170 ml hot toluene containing 0.5g p-toluene sulphonic acid. n-Butanol (333g, 4.5 Mole) was added and the mixture was heated under reflux for 24 hours, the evolved water being trapped in a Dean-Stark apparatus. After 28cc water had been collected, the product was stripped of excess alcohol, washed with 10 percent sodium carbonate to remove acid, and dried over anhydrous sodium sulphate.

After the toluene had been removed, the so-formed ester was dissolved in 200 cc chloroform and epoxidized using 100g of 70 percent monoperphthalic acid. The epoxidized solution was filtered to remove precipitated phthalic acid and washed with 10% sodium carbonate to remove excess perphthalic acid.

After drying over sodium sulphate, removal of chloroform left 64g pale yellow oil. The resulting epoxide was the monoepoxide corresponding to that of the above general formula, wherein $n$ is 0 and $R_1$ is butanol, and having an epoxy equivalency of 250, and designated compound 0 in Table 1 below.

Further examples of novel epoxides according to the present invention are as follows, referring to the general formula of the epoxides of the invention set forth above:

TABLE 1

| Compound | $R_1$ | $R_2$ | n |
|---|---|---|---|
| C | n-butyl | propylene | 8 |
| D | n-propyl | ethylene | 10 |
| E | ethyl | propylene | 10 |
| F | amyl | ethylene | 6 |
| G | n-propyl | mixed ethylene-dehydroxylated glycerol | 7 |
| H | phenyl | ethylene 9 | |
| I | tolyl | propylene | 5 |
| J | n-propyl | ethylene | 20 |
| K | isopropyl | propylene | 8 |
| L | n-octyl | ethylene | 4 |
| M | n-butyl | mixed ethylene-trimethylol propane | 7 |
| N | methyl | ethylene | 10 |
| O | butyl | — | 0 |
| P | isodecyl | — | 0 |

Preferred epoxides including monoepoxides and polyepoxides according to the invention are those in which $R_1$ is alkyl, particularly alkyl of from about 2 to about 8 carbon atoms, wherein $R_2$ is ethylene or propylene, and wherein $n$ is between 0 and about 10, and between about 1.5 to about 10 in the case of polyepoxides, and having an epoxy equivalency between about 250 and about 300 and a molecular weight ranging from about 350 to about 2000, particularly for incorporation of such epoxides in functional or hydraulic fluids. Polyepoxides according to the invention which are particularly effective for this purpose are those produced according to Examples 1 and 2 above and having a molecular weight ranging from about 500 to about 2,000. Particularly effective monoepoxides for this purpose are those having a molecular weight ranging from about 250 to about 450, e.g. the monoepoxide produced according to Example 4 above, wherein $R_1$ is butyl, or the monoepoxide wherein $R_1$ is isodecyl.

As previously noted, functional fluids containing the above polyepoxides include as base stock component as phosphorus compound selected from the group consisting of phosphorus esters and amides of an acid of phosphorus, or mixtures thereof.

Phosphorus esters which can be employed according to the invention have the general formula:

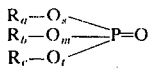

where $s$, $m$ and $t$ can be 0 or 1, and not more than two of $s$, $m$, and $t$ can be 0, where $R_a$, $R_b$ and $R_c$ each can be aryl such as phenyl and naphthyl, alkaryl such as cresyl, xylyl, ethyl phenyl, propyl phenyl, isopropyl phenyl, and the like, said aryl and alkaryl radicals preferably containing from 6 to about 8 carbon atoms, alkyl, both straight chain and branched chain of from about 3 to about 10 carbon atoms such as n-propyl, n-butyl, n-amyl, n-hexyl, isopropyl, isobutyl, and the like, and alkoxyalkyl having from about 3 to about 8 carbon atoms such as methoxy methyl, methoxy ethyl, ethoxy ethyl, methoxy propyl, and the like.

The corresponding phosphonates can also be employed, where one of $s$, $m$ and $t$ is 0, and the corresponding phosphinates where two of $s$, $m$ and $t$ are 0.

Preferred phosphorus esters are the dialkyl aryl, triaryl, trialkyl and alkyl diaryl phosphates.

Examples of such phosphate esters are the dialkyl aryl phosphates in which the alkyl groups are either straight chain or branched chain and contain from about 3 to about 10 carbon atoms, such as n-propyl, n-butyl, n-amyl, n-hexyl, isopropyl, isobutyl, isoamyl, and the aryl radicals have from 6 to 8 carbon aroms and can be phenyl, cresyl or xylyl, particularly dialkyl phenyl phosphates including dibutyl phenyl phosphate, butyl amyl phenyl phosphate, butyl hexyl phenyl phosphate, butyl heptyl phenyl phosphate, butyl octyl phenyl phosphate, diamyl phenyl phosphate, amyl hexyl phenyl phosphate, amyl heptyl phenyl phosphate, and dihexyl phosphate.

Examples of triaryl phosphates which can be employed in the invention compositions are those in which the aryl radicals of such phosphates have from 6 to 8 carbon atoms, that is, may be phenyl, cresyl or xylyl, and in which the total number of carbon atoms in all three of the aryl radicals is from 19 to 24, that is, in which the three radicals include at least one cresyl or xylyl radical. Examples of such phosphates include tricresyl, trixylyl, phenyl dicresyl, and cresyl diphenyl phosphates.

Examples of trialkyl phosphates employed according to the invention include phosphates having alkyl groups which are either straight chain or branched chain with from about 3 to about 10 carbon atoms, such as n-propyl n-butyl, n-amyl and n-hexyl, particularly tri-n-butyl phosphate, tri(2-ethyl hexyl) phosphate and triisononyl phosphate, the straight chain alkyl groups preferably containing from 4 to 6 carbon atoms.

Examples of alkyl diaryl phosphates which can be employed to produce the invention compositions include those in which the aryl radicals of such phosphates may have from 6 to 8 carbon atoms and may be phenyl, cresyl or xylyl, and the alkyl radical may have from about 3 to about 10 carbon atoms, examples of which are given above. Examples of the alkyl diaryl phosphates include butyl diphenyl, amyl diphenyl, hexyl diphenyl, heptyl diphenyl, octyl diphenyl, 6-methyl heptyl diphenyl, 2-ethylhexyl diphenyl, butyl phenyl cresyl, amyl phenyl xylyl, and butyl dicresyl phosphates.

Any phosphate ester can be employed which preferably is normally liquid between about −65°F and 210°F. The above-noted trialkyl phosphates such as tributyl phosphate or tri-n-hexyl phosphate are particularly effective in achieving low viscosity at low temperature. However, for improved higher viscosity at high temperature of the order of 210°F, it is desirably to employ triaryl phosphates as illustrated above, e.g. tricresyl phosphate, particularly in combination with the above-noted trialkyl phosphates.

Preferred phosphate esters are the above-noted dibutyl phenyl phosphate, tricresyl phosphate, tributyl phosphate, and octyl diphenyl phosphate, which can be employed separately or in combination.

Functional fluid base stocks according to the invention also can include phosphonate and phosphinate esters having alkyl and aryl groups corresponding to those defined above with respect to the phosphate esters.

Examples of phosphinate esters to which the invention principles are applicable include phenyl-di-n-propyl phosphinate, phenyl-di-n-butyl phosphinate, phenyl-di-n-pentyl phosphinate, p-methoxyphenyl-di-n-butyl phosphinate, tert-butylphenyl-di-n-butyl phosphinate. Examples of phosphonate esters to which the invention is applicable include aliphatic phosphonates such as an alkyl phosphonate, e.g., dioctyl isooctene phosphonate, an alkyl alkane phosphonate such as di-n-butyl n-octane phosphonate, di-isooctyl pentane phosphonate, and dimethyl decane phosphonate, a mixed alkyl aryl phosphonate, for example, dioctyl phenyl phosphonate, di(n-amyl) phenyl phosphonate, di (n-butyl) phenyl phosphonate, phenyl butyl hexane phosphonate and butyl bis-benzene phosphonate.

Another class of phosphorus compounds which can be employed according to the invention are the amides of acids of phosphorus, e.g., amido phosphates, including the mono-, di- and triamides of an acid of phosphorus, an example of which is phenyl N-methyl-N-n-butyl-N′-methyl-N′-n-butyl phosphoro-diamidate. Additional examples are m-cresyl-p-cresyl-N,N-dimethyl-phosphoroamidate, di-m-cresyl-N,N-dimethyl-phosphoroamidate, di-p-cresyl-N,N-dimethyl-phosphoroamidate, phenyl-N,N-dimethyl-N′,N′-dimethyl-phosphorodiamidate, N-methyl-N-butyl-N′-N′-tetramethylphosphorotriamidate, N,N′-di-n-propyl-N″-dimethylphosphorotriamidate.

Such functional fluid, as previously pointed out, also contains a viscosity index improver. One type of viscosity index improvers employed according to the present invention are high molecular weight polyalkylene glycol materials including polyalkylene glycols, e.g. polypropylene glycol, although the preferred materials of this type are mono- or diethers of polyalkylene glycols, or mixtures thereof. The ether end groups which preferably are present on the polyalkylene glycol viscosity index improvers hereof are preferably oxyalkyl groups, the alkyl radicals of which can range from 1 to about 8 carbon atoms in length, and preferably polyalkylene glycol mono- or diethers are employed having end alkyl groups of from 1 to 4 carbon atoms. Thus, preferred end alkyl groups are for example, methyl, ethyl, n-propyl, isopropyl, n-butyl, isobutyl, and the like, particularly methyl and butyl radicals.

The alkylene groups of the polyalkylene glycol viscosity index improver material can be an ethylene, propylene, or butylene group, or mixtures thereof, e.g. copolymers containing ethylene and propylene groups. The propylene polymers and ethylenepropylene copolymers are preferred, particularly the polypropylene glycol and copolymer of ethylene oxide and propylene oxide, mono and diethers.

The above polyalkylene glycol and ethers of polyalkylene glycol are well known and are prepared in known manner. Thus, generally mono- or diethers of polyalkylene of the type noted above can be produced by polymerization in known manner of ethylene oxide, propylene oxide or butylene-1-oxide or butylene-2-oxide, or mixtures of any one or all of these oxides.

The molecular weight of the polyalkylene glycol or polyalkylene glycol ether visocity index improvers can range from about 2,000 to about 20,000, preferably from about 2,000 to about 10,000. Preferred polyalkylene glycol ethers include the copolymer of ethylene oxide and propylene oxide, monobutyl ether, having a molecular weight ranging from about 4,000 to about 5,000, and polypropylene glycol monomethyl ether, having a molecular weight ranging from about 2,000 to about 3,000.

Other viscosity index improvers alternatively can be employed according to this invention. Such other viscosity index improvers include polyalkyl acrylates and methacrylates, in which the alkyl groups may contain from about 2 to about 18 carbon atoms, preferably about 4 to about 8 carbon atoms, either straight or branched chain, and having an average molecular weight ranging from about 2,000 to about 15,000. Thus, for example, polybutyl, polyamyl, polyhexyl and polyoctyl acrylates and methacrylates can be employed. Specific examples of such materials are poly n-butyl methacrylate and poly n-hexyl acrylate, having an average molecular weight between about 2,000 and 12,000.

As previously noted, the monoepoxides of the present invention are particularly effective, even at relatively high concentration, for preventing acid build-up and precipitation of harmful deposits in functional fluids containing the above polyacrylate and polymethacrylate viscosity index improvers, due to avoidance of reaction or cross-linking between such monoepoxides and acrylate-type viscosity index improvers.

Still other types of viscosity index improvers or thickeners which can be employed are the urethane polymer liquids, including urethane polyether or urethane polyester materials.

Generally, the base stock component of the functional or hydraulic fluid of the present invention, e.g., the phosphorus esters, is employed in major proportions and the viscosity index improver, e.g. polyalkylene glycol material, polyacrylate or polymethacrylate, and polyepoxy ester employed as acid acceptor are utilized in effective minor or small proportions in the fluid. Thus, the phosphorus esters and amides of an acid of phosphorus, or mixtures thereof, are generally employed in an amount ranging from about 50 to about 99.8%, preferably from about 75 to about 95%, the viscosity index improver, e.g. the polyalkylene glycol ether, or polyalkylene glycol, or polyacrylate or polymethacrylate, in an amount generally ranging from about 0.1 to about 30%, preferably about 3 to about 15%, and the novel epoxy compound or epoxy ester generally is employed in an amount ranging from about 0.1 to about 20%, preferably about 2 to about 10%, by weight.

It will also be understood that other commonly employed additives such as corrosion inhibitors, oxidation inhibitors, stabilizers, metal deactivators, and the like, such as dialkyl sulfides, benzothiazole, 1.2-bis (phenylthio) ethane, phenyl alpha naphthylamine and phenolic oxidation inhibitors, well known as functional fluid additives in the art, can also be incorporated in the functional fluid composition of the invention, in relatively small amounts, if desired.

The following are examples illustrating functional fluid compositions according to the invention, incorporating the novel epoxides and polyepoxides of the invention, such examples being only illustrative and are not intended as limitative of the invention.

EXAMPLE 5

The following composition containing a phosphate ester, a polyalkylene glycol ether and a polyepoxy ester according to the invention was prepared:

Composition AA

| COMPONENTS | Percent by weight |
|---|---|
| Dibutyl phenyl phosphate | 75.1 |
| Octyl diphenyl phosphate | 2.0 |
| Ucon 50 HB 5100 (a polyglycol ether) | 12.0 |
| Poly (ethylene-$\Delta^4$-epoxy tetrahydrophthalate) (mw - approx. 600) | 10.0 |
| 1,2-bis (phenylthio) ethane | 0.5 |
| water | 0.4 |
| | 100.0% |

Ucon 50 HB 5100 is understood to be the copolymer of ethylene oxide and propylene oxide, monobutyl ether, molecular weight 4,000–5,000.

The above composition or fluid had the following properties.

TABLE 2

| | |
|---|---|
| AIT (autoignition temperature) | 930°F |
| Flash point | 370°F |
| Fire point | 420°F |
| Viscosity - centistokes(cs) - 65°F | 420 |
| 210°F | 3.25 |
| Density | 1.06 |

Closed oxidation-corrosion tests at 250°F for 168 hours were carried out in two tests on each of the metals listed in Table 3 below, the respective metals being immersed in a separate liquid composition AA above in each of the two tests. The results of these tests are set forth in Table 3 below in terms of weight change in mg/cm$^2$ for each of the metals in each of the two tests.

TABLE 3

| | Test 1 | Test 2 |
|---|---|---|
| Iron | −0.01 | 0 |
| Bronze | 0 | — |
| Copper | — | −0.08 |
| Cadmium plate | −0.04 | −0.05 |
| Aluminum | 0 | 0 |
| Titanium | 0 | — |
| Magnesium | — | −0.05 |

The acid number for the fluid in both tests was initially 0.04, and the fluid remained clear for both tests, with no trace of precipitation of insoluble deposits, the final acid number of the fluid in both tests being 0.04.

EXAMPLE 6

The following additional functional or hydraulic fluids were prepared according to the invention.

COMPOSITION BB

| Components | Percent by weight |
|---|---|
| Dibutyl phenyl phosphate | 84.1 |
| Octyl diphenyl phosphate | 2.0 |
| Ucon 50 HB 5100 | 8.0 |
| Poly(ethylene-$\Delta^4$-epoxy tetrahydrophthalate)(mw approx. 1500) | 5.0 |
| 1,2-bis (phenylthio) ethane | 0.5 |
| Water | 0.4 |
| | 100.0 |

COMPOSITION CC

| Components | Percent by weight |
|---|---|
| Dibutyl phenyl phosphate | 80.1 |
| Octyl diphenyl phosphate | 2.0 |
| Jeffox OL 2700 (a polyglycol ether) | 11.0 |
| Poly (ethylene-$\Delta^4$-epoxy tetrahydrophthalate) (mw approx. 1000) | 6.0 |
| 1,2-bis (phenylthio) ethane | 0.5 |
| Water | 0.4 |
| | 100.0 |

Jeffox OL 2700 is understood to be a polypropylene glycol monomethyl ether, molecular weight about 3,000.

Closed oxidation-corrosion tests were carried out for each of the fluids or compositions BB and CC above, in the same manner as noted above in Example 5.

It was noted that both of the fluids BB and CC tested remained clear throughout these test with no deposits therein throughout the tests, and the acid number of both of the fluids BB and CC tested remained throughout the tests and at the end thereof close to the initial acid number prior to testing, the acid number for each of these fluids being 0.04

EXAMPLE 7

The following functional or hydraulic fluid was prepared.

COMPOSITION DD

| Components | Percent by weight |
|---|---|
| Dibutyl phenyl phosphate | 89.0 |
| Polyacryloid HF 412 5.0 | |
| Poly (ethylene-$\Delta^4$-epoxy tetrahydrophthalate) (mw approx. 500) | 5.0 |
| 1,2-bis (phenylthio) ethane | 0.5 |
| Water | 0.5 |
| | 100.0 |

Polyacryloid HF 412 is understood to be poly n-butyl nethacrylate, mw about 7,900.

Closed oxidation-corrosion tests were carried out employing fluid DD above, such tests being carried out substantially according to the closed oxidation-corrosion tests in Example 5 above.

Throughout these tests no deposits were observed in the fluid and the acid number of the fluid at the end of these tests was close to the acid number of the fluid at the commencement of the tests.

EXAMPLE 8

The following fluids are also illustrative of the functional or hydraulic fluids of the invention, the specific epoxy esters noted in Table 4 below being defined in Table 1 above.

TABLE 4

| Components | | COMPOSITIONS (% by weight) EE | FF | GG | HH | JJ | KK | LL | MM | NN | OO |
|---|---|---|---|---|---|---|---|---|---|---|---|
| Dibutyl phenyl phosphate | | 85 | 86 | 45 | 64 | 75 | — | 80 | — | 90 | — |
| Octyl diphenyl phosphate | | — | 2 | 18 | — | — | — | — | — | — | — |
| Tributyl phosphate | | — | 2 | 20 | 15 | — | 40 | 10 | — | — | 82 |
| Tricresyl phosphate | | — | — | — | — | — | 40 | — | — | — | 8 |
| phenyl N-methyl-N-n-butyl-N'-methyl-N'n-butyl phosphoro-diamidate | | — | — | — | — | — | — | — | 90 | — | — |
| Ucon 50 HB 5100 | | — | 6 | — | 15 — | 6 | 5 | — | — | — | |
| Polyn-butyl methacrylate (mw. 7,900) | | — | — | — | — | — | — | — | — | 7 | 4 |
| Polyn-hexylacrylate (mw 6,000) | | — | — | — | — | — | — | — | — | — | 3 |
| Jeffox OL 2700 | | 8 | — | 14 | — | 15 | 10 | — | — | — | — |
| Ucon LB 1715 | | — | — | — | — | — | — | — | 7 | — | — |
| Compound C | epoxy ester | 7 | — | — | — | — | 4 | 5 | — | — | — |
| Compound D | epoxy ester | — | 4 | — | — | — | — | — | 3 | — | — |
| Compound G | epoxy ester | — | — | 3 | — | — | — | — | — | — | — |
| Compound I | epoxy ester | — | — | — | 6 | — | — | — | — | — | — |
| Compound P | epoxy ester | — | — | — | — | 10 | — | — | — | 3 | 3 |
| | | 100 | 100 | 100 | 100 | 100 | 100 | 100 | 100 | 100 | 100 |

EXAMPLE 9

The following functional or hydraulic fluids were prepared:

COMPOSITION PP

| Components | Percent by weight |
|---|---|
| Dibutyl phenyl phosphate | 90 |
| Poly n-butyl methacrylate (mw 7,900) | 7 |
| Monoepoxide | 3 |
| | 100.0 |

COMPOSITION QQ

| | |
|---|---|
| Tri-n-butyl phosphate | 82 |
| Tricresyl phosphate | 8 |
| Poly n-butyl methacrylate (mw. 7,900) | 4 |
| Poly n-hexyl acrylate (mw. 6,000) | 3 |
| Monoepoxide | 3 |
| | 100.0 |

The monoepoxide of Compositions PP and QQ above is the compound 0 of Table 1 above, produced by the procedure of Example 4 above, namely, dibutyl-4,5-epoxycyclohexane -1,2-dicarboxylate.

The above compositions had the following properties.

TABLE 5

| | | Compositions PP | QQ |
|---|---|---|---|
| AIT | | 930°F | 740°F |
| Flash point | | 365°F | 340°F |
| Fire point | | 415°F | 365°F |
| Viscosity (cs) | −65°F | 3800 | 2000 |
| | 210°F | 3.65 | 3.31 |
| Density | | 1.06 | 0.99 |

It is noted that the novel epoxide or epoxy ester components in Examples 5 to 9 above were employed in relatively high concentration ranging from 3 to 10 percent, when employed in combination with either a polyglycol ether or a polyalkyl methacrylate as viscosity index improver, and resulting in maintaining the fluids, containing phosphate ester base stock clear, with no formation of precipitates or deposits in the fluid.

In addition to their valuable applications as hydraulic fluids for aircraft hydraulic systems, the fluids according to the present invention have important applications as hydraulic functional fluids in industrial and marine fields, particularly in industrial turbine systems.

From the foregoing, it is seen that in accordance with the invention, novel epoxide compounds, in the form of esters of 4,5-epoxy-1,2-cyclohexane dicarboxylic acid are provided having valuable applications, and particularly in functional fluids designed particularly for use as hydraulic fluids in jet aircraft, such functional fluids being in the form of a mixture of a phosphorus compound, preferably a phosphate ester, a viscosity index improver, such as a polyalkalene glycol material, e.g. a polypropylene glycol ether of high molecular weight, or a polyalkyl acrylate or methacrylate, and a small amount of the novel epoxide, e.g. mono- or polyepoxide, compound of the invention. The resulting functional or hydraulic fluids have controlled low acidity and absence of deposits harmful to hydraulic fluid system components, and good viscosity characteristics both at low and high temperature, such fluids at the same time having good thermal and hydrolytic stability, and having fire resistance and corrosion and pump wear resistance comparable to conventionally employed phosphate ester hydraulic fluids.

While I have described particular embodiments of my invention for the purpose of illustration within the spirit of the invention, it will be understood that the invention is not to be taken as limited except by the scope of the appended claims.

I claim:

1. A functional fluid composition consisting essentially of by weight (1) about 50 to about 99.8 percent of a phosphorus compound selected from the group consisting of phosphorus esters and amides of an acid of phosphorus, and mixtures thereof, (2) about 0.1 to about 30 percent of a viscosity index improver, and (3) about 0.2 to about 20 percent of an epoxy compound sufficient to prevent precipitation of deposits in said fluid, said epoxy compound having the general formula

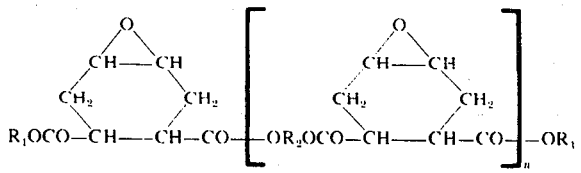

wherein $R_1$ is selected from the group consisting of alkyl of from 1 to 10 carbon atoms, aryl of from 6 to 9 carbon atoms, alkoxy alkyl wherein the total number of carbon atoms ranges from 2 to about 10, and halogenated aryl of from 6 to 9 carbon atoms, $R_2$ is selected from the group consisting of alkylene of from 2 to 4 carbon atoms, polyalkylene oxides, the alkylene group thereof containing from 2 to 4 carbon atoms, arylene oxides containing from 6 to 15 carbon atoms, and wherein a portion of said $R_2$ radical can be replaced by $R_3$, $R_3$ being a polyvalent radical of the hydrocarbon portion of a polyhydric alcohol selected from the group consisting of trihydric and tetrahydric alcohols, and wherein *n* can range from about 1 to about 50, and having a molecular weight up to about 10,000.

2. A functional fluid composition as defined in claim 1, said viscosity index improver being selected from the group consisting of (a) a polyalkylene glycol viscosity index improver of the group consisting of polyalkylene glycols and polyalkylene glycol mono- and diethers containing at least one oxyalkyl end group wherein the alkyl radicals contain from 1 to about 8 carbon atoms, said alkylene groups being selected from the class consisting of ethylene, propylene and butylene, and mixtures thereof, said polyalkylene glycol viscosity index improver having a molecular weight ranging from about 2,000 to about 20,000, and (b) an acrylate viscosity index improver selected from the group consisting of polyacrylates and polymethacrylates, wherein the alkyl group contains from about 2 to about 18 carbon atoms, and having a molecular weight ranging from about 2,000 to about 15,000.

3. A functional fluid composition as defined in claim 2, wherein said viscosity index improver is said polyalkylene glycol viscosity index improver.

4. A functional fluid composition as defined in claim 2, said polyalkylene glycol viscosity index improver being a polyalkylene glycol ether containing at least 1 terminal oxylalkyl group of from 2 to 4 carbon atoms.

5. A functional fluid composition as defined in claim 2, said polyalkylene glycol ether being a member selected from the group consisting of polyproplyene glycol and copolymer of ethylene oxide and propylene oxide.

6. A functional fluid composition as defined in claim 2, wherein said phosphorus compound is a phosphorus ester having the general formula

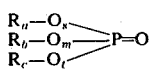

where *s*, *m* and *t* are each an integer of 0 to 1, and not more than two of *s*, *m* and *t* are O, $R_a$, $R_b$, and $R_c$ are each a member selected from the group consisting of aryl, alkaryl, alkyl of from about 3 to about 10 carbon atoms, and alkoxyalkyl having from about 3 to about 8 carbon atoms.

7. A functional fluid composition as defined in claim 2, wherein said phosphorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

8. A functional fluid composition as defined in claim 7 said viscosity index improver being a polyalkylene glycol ether containing at least one terminal oxyalkyl group of from 1 to 4 carbon atoms.

9. A functional fluid composition as defined in claim 7, wherein said viscosity index improver is an acrylate viscosity index improver selected from the group consisting of polyacrylates and polymethacrylates, wherein the alkyl group contains from about 2 to about 18 carbon atoms, and having a molecular weight ranging from about 2,000 to about 15,000.

10. A functional fluid composition as defined in claim 7, wherein said phosphorus compound is employed in the amount ranging from about 75 to about 95 percent, said viscosity index improver is employed in the amount ranging from about 3 to about 15 percent, and said epoxy compound is employed in an amount ranging from about 2 to about 10 percent by weight.

11. A functional fluid composition as defined in claim 2, wherein $R_1$ in said epoxy compound is alkyl of from 1 to 10 carbon atoms and *n* is 1.

12. A functional fluid composition as defined in claim 11, wherein said phosphorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24, said viscosity index improver being an acrylate viscosity index improver selected from the group consisting of polyacrylates and polymethacrylates, wherein the alkyl group contains from about 2 to about 18 carbon atoms, and having a molecular weight ranging from about 2,000 to about 15,000.

13. A functional fluid composition as defined in claim 12, wherein said phosphorus compound is a phosphate ester selected from the group consisting of dibutyl phenyl phosphate, tricresyl phosphate, octyl diphenyl phosphate and tributyl phosphate.

14. A functional fluid composition as defined in claim 13, wherein $R_1$ in said epoxy compound is selected from the group consisting of butyl and isodecyl, and wherein said phosphate ester includes dibutyl phenyl phosphate.

15. A functional fluid composition as defined in claim 13, wherein $R_1$ in said epoxy compound is selected from the group consisting of butyl and isodecyl, and wherein said phosphate ester includes tributyl phosphate.

16. A functional fluid composition as defined in claim 1, wherein $R_1$ in said epoxy compound is alkyl of from 1 to 10 carbon atoms and $R_2$ of said epoxy compound is alkylene, the alkylene group thereof containing from 2 to 4 carbon atoms, and n of said epoxy compound ranges from 1 to about 10.

17. A functional fluid composition as defined in claim 16, said viscosity index improver being a polyalkylene glycol viscosity index improver of the group consisting of polyalkylene glycols and polyalkylene glycol mono- and diethers containing at least one oxyalkyl end group wherein the alkyl radicals contain from 1 to about 8 carbon atoms, said alkylene groups being selected from the class consisting of ethylene, propylene and butylene, and mixtures thereof, said polyalkylene glycol viscosity index improver having a molecular weight ranging from about 2,000 to about 20,000.

18. A functional fluid composition as defined in claim 16, wherein said phosphorus compound is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

19. A functional fluid composition as defined in claim 1, wherein n in said epoxy compound ranges from about 1 to about 10.

20. A functional fluid composition as defined in claim 1, wherein n in said epoxy compound ranges from about 1 to about 8, and the molecular weight ranges from about 500 to about 2,000.

21. A functional fluid composition consisting essentially of, by weight, (1) about 50 to about 99.8 percent of a phosphorus compound selected from the group consisting of phosphorus esters and amides of an acid of phosphorus, and mixtures thereof, (2) about 0.1 to about 30 percent of a viscosity index improver, and (3) about 0.2 to about 20 percent of an epoxy compound sufficient to prevent precipitation of deposits in said fluid, said epoxy compound having the general formula

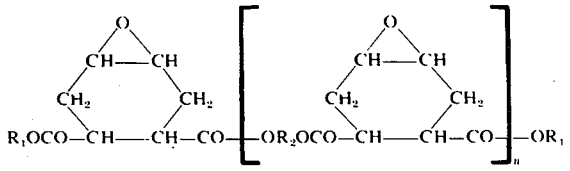

wherein $R_1$ is alkyl of from 1 to 10 carbon atoms, and $R_2$ is alkylene, the alkylene group thereof containing from 2 to 4 carbon atoms, and n of said epoxy compound ranges from 1 to about 10, said viscosity index improver being selected from the group consisting of (a) a polyalkylene glycol viscosity index improver of the group consisting of polyalkylene glycols and polyalkylene glycol mono- and diethers containing at least one oxyalkyl end group wherein the alkyl radicals contain from 1 to about 8 carbon atoms, said alkylene groups being selected from the class consisting of ethylene, propylene and butylene, and mixtures thereof, said polyalkylene glycol viscosity index improver having a molecular weight ranging from about 2,000 to about 20,000, and (b) an acrylate viscosity index improver selected from the group consisting of polyacrylates and polymethacrylates, wherein the alkyl group contains from about 2 to about 18 carbon atoms, and having a molecular weight ranging from about 2,000 to about 15,000.

22. A functional fluid composition as defined in claim 21, said polyalkylene glycol ether being a member selected from the group consisting of polypropylene glycol and copolymer of ethylene oxide and propylene oxide.

23. A functional fluid composition as defined in claim 21, wherein said viscosity index improver is an acrylate viscosity index improver selected from the group consisting of polyacrylates and polymethacrylates, wherein the alkyl group contains from about 2 to about 18 carbon atoms, and having a molecular weight ranging from about 2,000 to about 15,000.

24. A functional fluid composition as defined in claim 23, wherein said phosphorus compound is a phosphate ester selected from the group consisting of dialkyl aryl triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

25. A functional fluid composition as defined in claim 21, said viscosity index improver being a polyalkylene glycol ether selected from the group consisting of polypropylene glycol and copolymer of ethylene oxide and propylene oxide, mono- and diethers.

26. A functional fluid composition as defined in claim 25, wherein said phosphorus compount is a phosphate ester selected from the group consisting of dialkyl aryl, triaryl, trialkyl and alkyl diaryl phosphates, said alkyl groups containing from about 3 to about 10 carbon atoms and said aryl groups containing from 6 to 8 carbon atoms, the total number of carbon atoms in all three aryl groups in said triaryl phosphates being from 19 to 24.

27. A functional fluid composition as defined in claim 26 wherein said epoxy compound is a polyepoxide having a molecular weight ranging from about 500 to about 2,000, and has an epoxy equivalency ranging from about 250 to about 300.

28. A functional fluid composition as defined in claim 27, wherein said phosphorus compound is a phosphate ester selected from the group consisting of dibutyl phenyl phosphate, tricresyl phosphate, octyl diphenyl phosphate and tributyl phosphate.

29. A functional fluid composition as defined in claim 21, said viscosity index improver being selected from the group consisting of poly n-butyl methacrylate and poly-n-hexyl acrylate having an average molecular weight between about 2,000 and about 12,000.

30. A functional fluid composition as defined in claim 21, wherein said phosphorus compound is employed in the amount ranging from about 75 to about 95 percent, said viscosity index improver is employed in the amount ranging from about 3 to about 15 percent, and said epoxy compound is employed in an amount ranging from about 2 to about 10 percent, by weight.

31. A functional fluid composition as defined in claim 21, wherein said phosphorus compound is a phosphate ester selected from the group consisting of dibutyl phenyl phosphate, tricresyl phosphate, octyl diphenyl phosphate and tributyl phosphate.

32. A functional fluid composition as defined in claim 31, said epoxy compound being poly(ethylene-$\Delta^4$-epoxy tetrahydrophthalate).

33. A functional fluid composition as defined in claim 21, said epoxy compound being poly(ethylene-$\Delta^4$-epoxy tetrahydrophthalate).

* * * * *